United States Patent [19]

Risher

[11] 4,070,929

[45] Jan. 31, 1978

[54] TOOL SHARPENING APPARATUS

[76] Inventor: Francis E. Risher, 906-25th St., Canton, Ohio 44709

[21] Appl. No.: 697,719

[22] Filed: June 21, 1976

[51] Int. Cl.[2] ..... B21K 5/12

[52] U.S. Cl. ..... 76/82; 76/88; 51/221 BS

[58] Field of Search ..... 76/82, 82.2, 88, 36; 51/221 BS, 59 R

[56] References Cited

U.S. PATENT DOCUMENTS

| | | | |
|---|---|---|---|
| 700,562 | 5/1902 | Ruhl | 76/82 |
| 849,180 | 4/1907 | Wilson | 76/87.2 |
| 951,961 | 3/1910 | Miotke | 76/82 |
| 1,904,075 | 4/1933 | Petrich | 76/82.2 |

*Primary Examiner*—Harold D. Whitehead

*Assistant Examiner*—Roscoe V. Parker, Jr.

*Attorney, Agent, or Firm*—Imirie, Smiley & Guay

[57] ABSTRACT

Tool sharpening apparatus including a base member having a first support carrying a floating head and a second support for receiving the tool to be sharpened and for holding the same in proper position. A sharpening element, such as a file, is mounted for longitudinal reciprocal movement on the floating head for sharpening the tool. The floating head member is biased away from its support member and is movable vertically to move the file into and out of engagement with the leading edge of the tool so that slight pressure on the file on the forward stroke moves the assembly down into engagement with the tool, and release of such pressure when pulling the file back allows the file to be urged away from the tool.

10 Claims, 7 Drawing Figures

TOOL SHARPENING APPARATUS

BACKGROUND OF THE INVENTION

1. Field of the Invention

The present invention relates generally to apparatus for the sharpening of tools, and, more particularly, to the sharpening of spatulas and the like flat bladed implements.

2. Description of the Prior Art

Many different devices have been developed for the sharpening of tools, and are commonplace in machine shops and the like. However, such devices, designed for precision sharpening of tools, are typically complex or require a high degree of skill in their operation. Other, simpler approaches also have been developed for day-to-day use in, for example, kitchens for the sharpening of culinary utensils. While such devices are generally simple in construction and operation, the quality of the sharpening process is typically quite low.

Problems are encountered in, for example, commercial restaurants and, most particularly, fast food restaurants involving the need to quickly and efficiently sharpen spatulas in a simple and convenient manner. In such establishments, food is cooked on a large metal surface and the cook utilizes the spatula for various purposes. Typically, the spatulas have a flat section, for turning the food during the cooking process, and a handle section at a relatively oblique angle with respect thereto. In order to turn the food on the cooking surface, it is beneficial that the leading edge of the spatula be relatively sharp in order to part the food from the grill. Once the cooking process has been completed, the cook then rotates the spatula to a reverse orientation from that for turning the food and employs the same as a scraper to clean particles of food from the grill. Again, it is highly beneficial that the end or leading edge of the spatula be kept relatively sharp for greatest efficiency.

The problem encountered in these environments is the dulling of the leading edge of the spatula during extended use, and thus the requirement for periodic sharpening of the tool. Currently, no fully convenient apparatus is available to aid in this task and the sharpening typically must be accomplished by hand so that the edge of the blade becomes non-straight or out-of-line. At the same time, it is necessary to provide a device which may be used by operators with a minimum of familiarity with machinery or machine tools but which device nonetheless provides accurate and fully satisfactory sharpening results even at the hands of inexperienced users.

Illustrative of one approach to these ends is U.S. Pat. No. 700,562 which provides a grooved or V-shaped sharpening member secured in reciprocable engagement with a knife blade. The sharpening member is caused to reciprocate in constant contact with the knife edge to effect sharpening thereof. While this device is satisfactory for sharpening a knife blade, it is ineffective for filing the edge of spatulas in view of the constant contact of the sharpening member with the tool.

Another device exemplary of those heretofore employed for sharpening tools is disclosed in U.S. Pat. No. 2,707,409. This device is designed for the sharpening of chainsaw blades, particularly by those unskilled in this area. Basically, there are provided means for locating the tooth to be sharpened and a guide to direct a file at an appropriate angle with respect thereto. Again, however, such apparatus is not totally satisfactory in the absence of any mechanism to prevent the file from engaging the chain on the return stroke.

Various fixtures or jigs have been developed to aid in the sharpening of tools. See, for example, U.S. Pat. Nos. 951,961 and 3,011,366. The common feature of such fixtures is the ability to adjust the device whereby the tool held in the fixture may be sharpened or abraded to a predetermined level whereupon further removal of metal is prevented. While satisfactory to this end, devices of this general type again fail to release the file from the tool on the reverse stroke and, by virtue of their guide rollers, cause the file to rapidly become dull.

Accordingly, the need exists to provide a tool sharpening apparatus which overcomes the manifest disadvantages of prior art apparatus, particularly for the sharpening of spatulas.

SUMMARY OF THE INVENTION

It is, therefore, an object of the present invention to simply, economically, conveniently, and accurately sharpen tools.

Another object of the present invention is to sharpening culinary devices, particularly spatulas, without extensive training or the use of expensive equipment.

It is a further object of this invention to construct apparatus for the sharpening of spatulas in which a sharpening element is constrained for reciprocal movement in only one direction without permitting tilting, rocking, or any other misalignment, and at the same time is movable in a second direction away from and toward the tool edge for contact therewith on the forward stroke and disengagement on the return stroke.

In accordance with the foregoing objects, there is provided a tool sharpening apparatus including a base member, a support on said base for securely holding a tool having a substantially straight edge to be sharpened, a head member reciprocably carried on the base for movement toward and away from the edge of a tool held by the support, a sharpening element slidably mounted on the head member for reciprocable motion in a predetermined path along the tool edge, and an element biasing the head member away from the tool edge, whereby the head member is moved downwardly for engagement of the sharpening element with the tool edge on a forward stroke thereof and is urged upwardly to separate the sharpening element from the tool edge on a return stroke.

The present invention is advantageous over the prior art in that a sharpening element is held in accurate and positive alignment with respect to the tool to be sharpened, that sharpening is accomplished only on the forward stroke with the sharpening element and tool automatically separated during the return stroke, and that the tool to be sharpened may be properly positioned in the apparatus without difficulty.

Other objects and advantages of the present invention will become apparent from the following description of the preferred embodiment when taken in conjunction with the accompanying drawings.

DESCRIPTION OF THE PREFERRED EMBODIMENT

Figure 1:
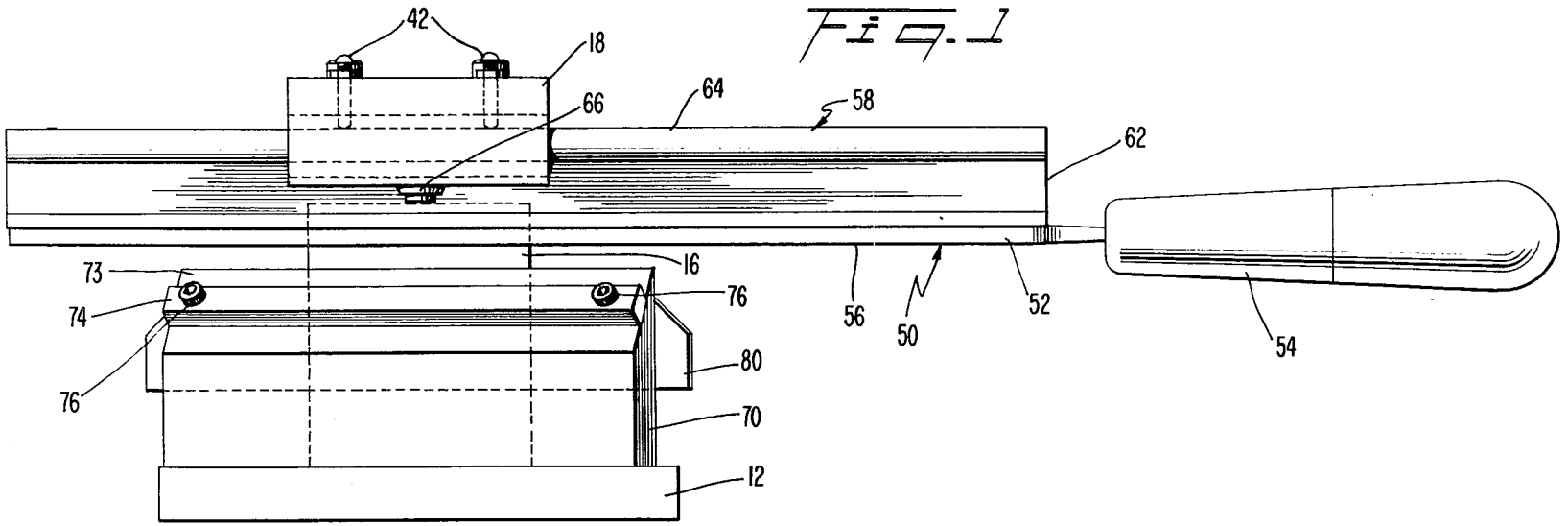
FIG. 1 is a front elevational view of a preferred embodiment of a tool sharpening apparatus according to the present invention.
Figure 2:
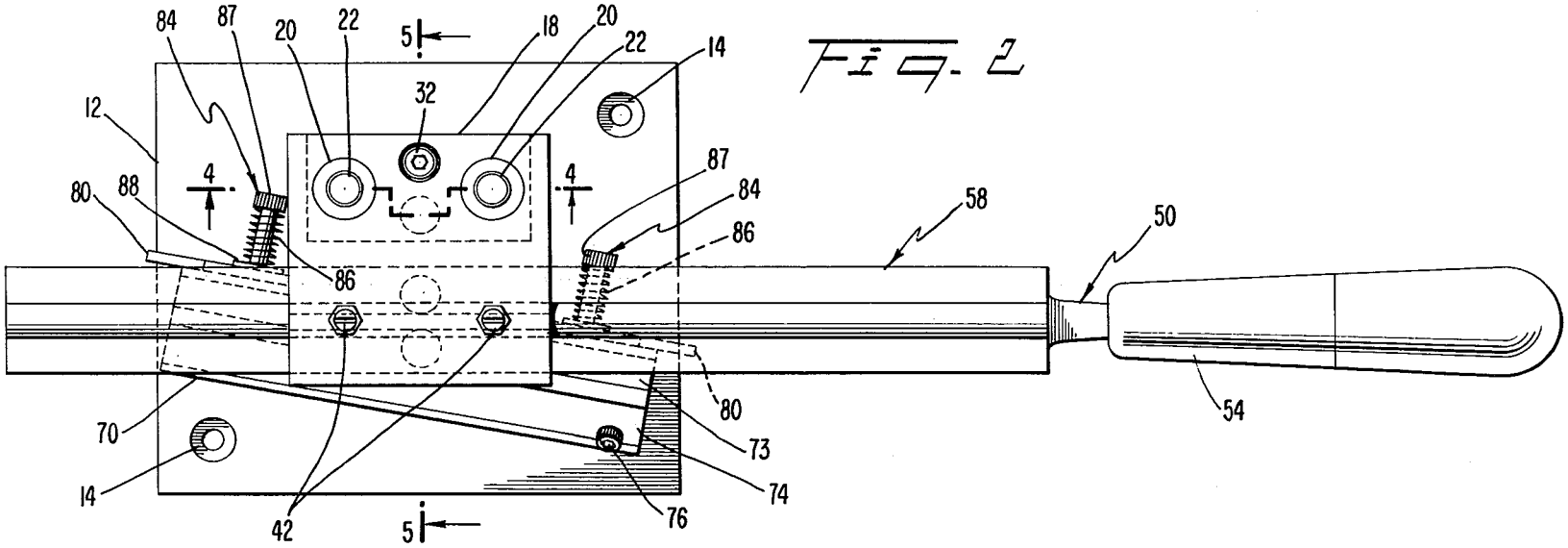
FIG. 2 is a top plan view of the tool sharpening apparatus of FIG. 1.
Figures 3, 4:
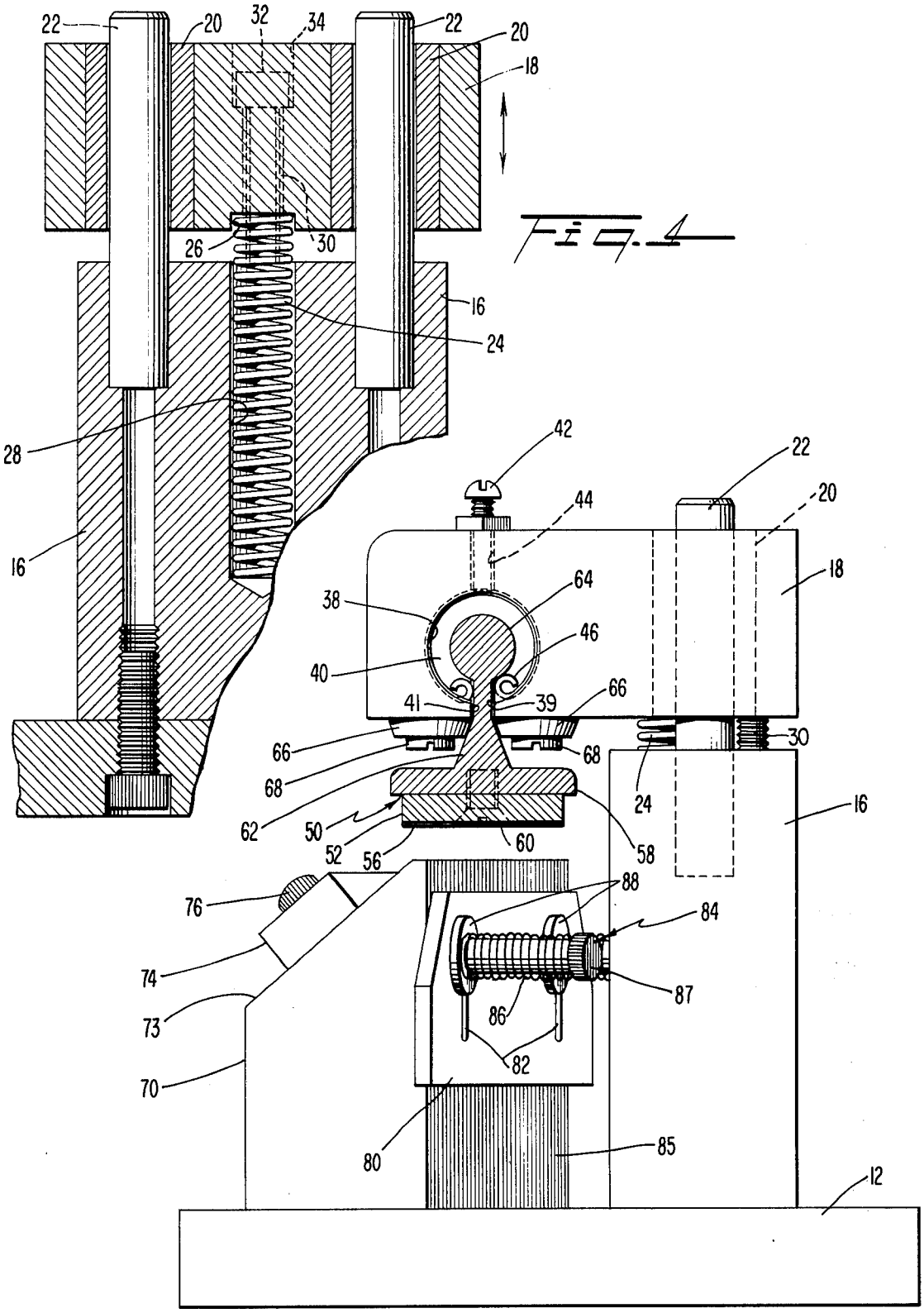
FIG. 3 is a side elevational view of the tool sharpening apparatus of FIG. 1.
FIG. 4 is a sectional view taken along line 4—4 of FIG. 1.

Referring to FIGS. 1-3, a preferred embodiment of the present invention has a base member 12 which may be secured to any suitable, rigid table, bench, or the like by fasteners, such as bolts or screws extending through holes 14.

A first upstanding support member 16 is fixedly attached to the base and carries a floating head member 18 in reciprocable engagement therewith. The head member 18 defines a pair of holes each fitted with bearings 20 which preferably are ball bushings. Through these bushings 20 are disposed a pair of guide pins 22 which are press fit or otherwise firmly attached to and project upwardly from support member 16. The guide pins 22 cooperate with the bushings 20 to allow free, reciprocal motion of head member 18 on the support 16. This relationship is best viewed in FIGS. 4-6.

A biasing element 24, such as a coil spring, is provided to urge head member 18 away from support member 16. As best viewed in FIG. 4, the spring 24 is disposed in opposing bores 26, 28 in head member 18 and support member 16, respectively, and is held in compression therebetween. The degree to which head member 18 may be displaced from support member 16 by means of spring 26 is determined by an adjustable stop in the form of a threaded bolt 30 freely extends through a bore 31 in head member 18 and. The bolt 30 has an enlarged head portion 32 which passes partially through head member 18 in a counterbore 34. Bolt 30 is threaded into a tapped hole 36 (FIG. 5) in the base member 16 and is thereby adjustable to permit a fairly wide range over which head member 18 may move on guide pins 22 relative to support member 16.

Floating head 18 is also provided with a transverse bore 38 having one or more bearings 40, preferably ball bushings, disposed therein. Screws 42 extend through threaded holes 44 in head member 18 in order to secure the bushings 40 against rotation or other movement relative to bore 38. Retaining clips 46, best viewed in FIG. 3, are provided to reduce end play of bushings 40. The bore 38 and bushings 40 have radially disposed, longitudinally extending aligned slots 39, 41 opening through the bottom surface of head member 18.

The sharpening element, generally designated as 50, is comprised of a standard file 52 having a handle member 54 and an abrasive portion 56. The file is attached to a support member 58 by screws 60, as best viewed in FIG. 3. The support 58 is formed with a rail portion 62, which extends radially from a guide shaft 64 and passes through slots 39, 41. Guide shaft 64 is designed to travel axially within the bearings 40, and allows the file to freely reciprocate across a path limited by the terminal ends of the shaft.

It is important that the face of the file 52 be restricted within a single plane of motion, i.e., that no rocking or side motion be allowed. To prevent such undesired motion, a pair of rollers 66 are disposed, one on each side of the rail 62, on the underside of the head member 18. Rollers 66, which may be manufactured from any suitable material, such as PTFE, or which may be small roller or ball bearings, are secured to head member 18 by axel bolts 68. Rollers 66 preferably are machined to have an angular face which contacts the mating angular face of rail member 62, as shown in FIG. 3, although other suitable configurations may be used.

Figure 5:
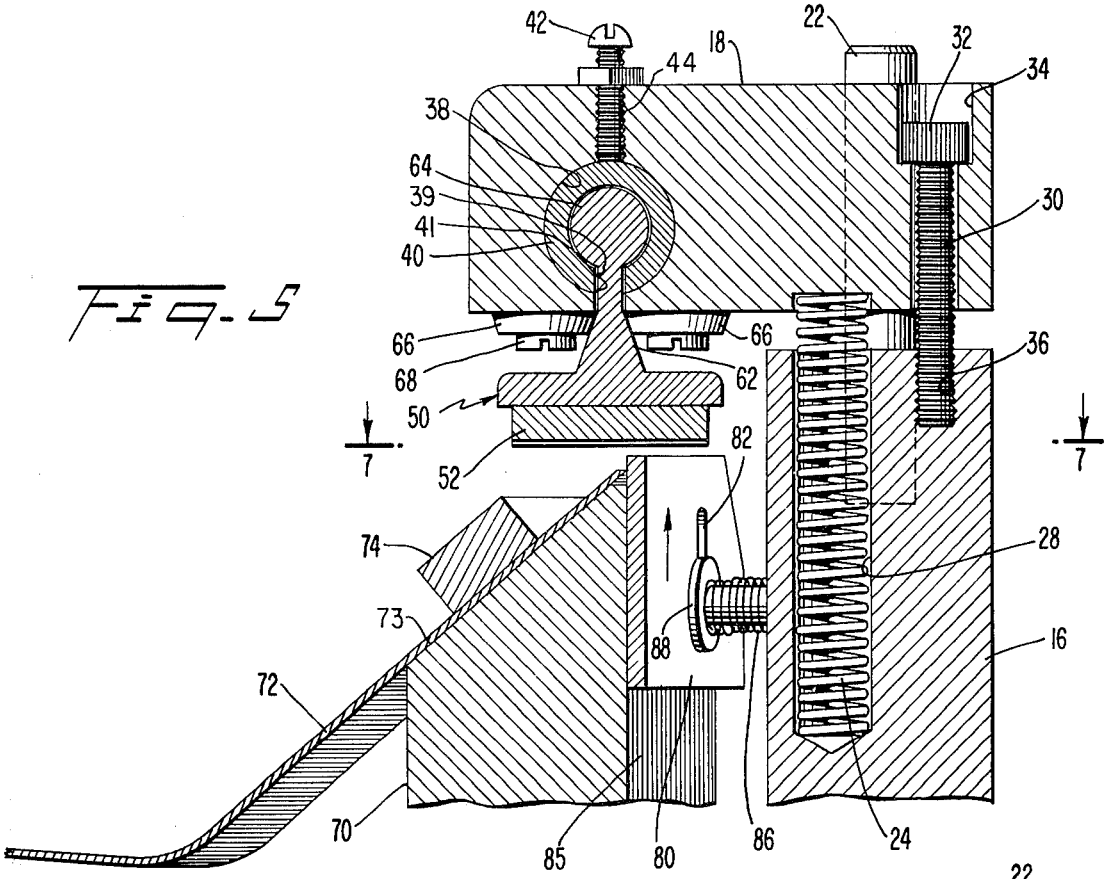
FIG. 5 is a sectional view taken along line 5—5 of FIG. 1, showing the device in a position for inserting a spatula.
Figure 6:
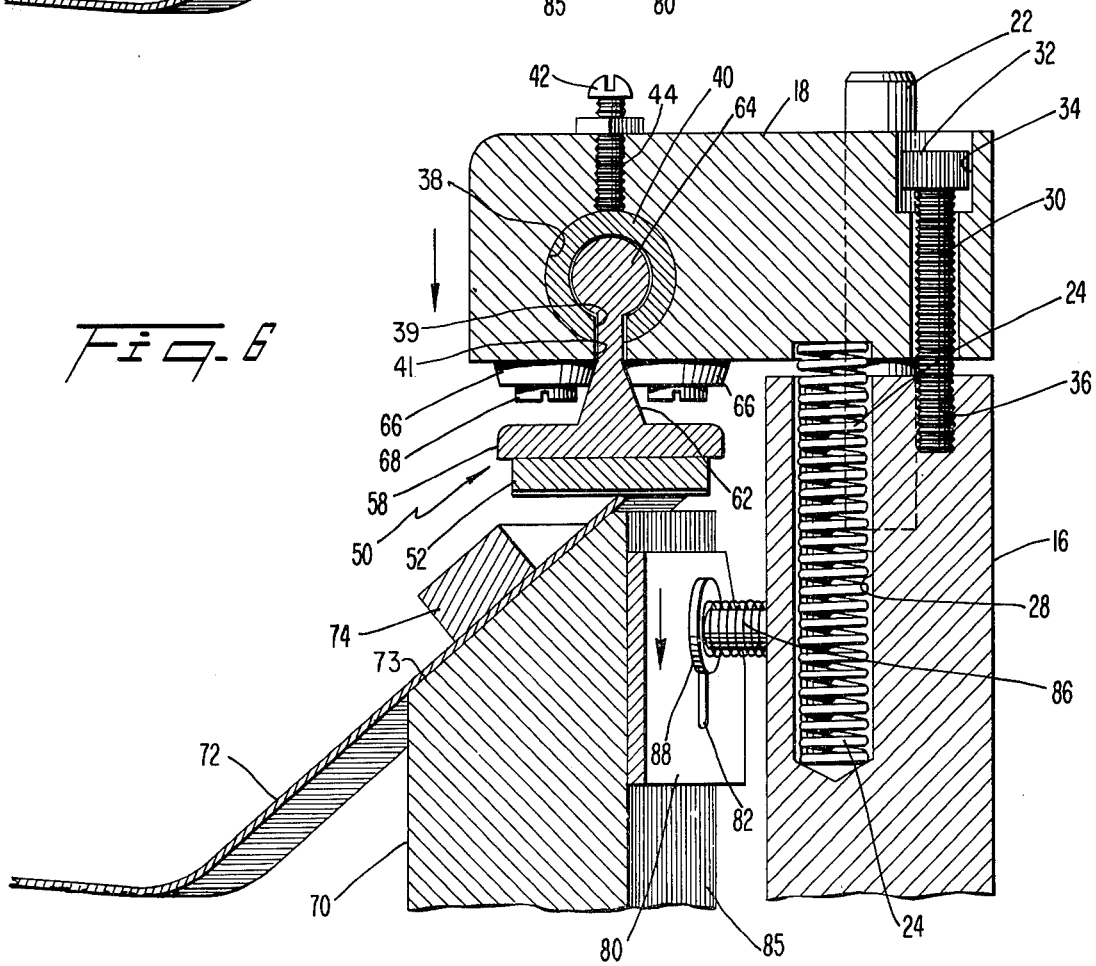
FIG. 6 is a sectional view, similar to FIG. 5, but showing the device in a sharpening position.

A second support member 70 is attached to the base member 12 and is designed to receive a tool, such as spatula 72, to be sharpened. The support member 70 has an inclined face 73 on which is provided a plate 74 attached thereto by means of bolts 76. The spatula 72 is inserted between the inclined face 73 of support 70 and the bottom face of plate 74, as shown in FIGS. 5-7, and bolts 76 are then tightened to securely lock the spatula in place with the leading edge thereof in the reciprocable path of sharpening element 50.

A positioning plate 80 is carried upon support 70, for the accurate alignment of spatula 72 on the support member. Positioning plate 80 is generally rectangular and has a pair of elongated slots 82, as shown in FIG. 3. The plate is attached to the inner side face 85 of support 70 by a pair of threaded bolts 84 which pass freely through slots 82 in plate 80 and are mounted in tapped holes (not shown) in the side face 85 of support member 70. The bolts 84 are provided with a pair of springs 86 each of which is compressed between the head 87 of bolt 84, and a washer 88, so as to urge positioning plate 80 into frictional engagement with side face 85 of the support member. In this manner, the plate may be moved between an upper position, shown in FIG. 5, and a lower position, shown in FIG. 6. When the spatula is to be inserted, positioning plate 80 is slid upwardly as shown in FIG. 5 thereby to provide a stop against which the working edge of spatula 72 may be positioned. The spatula is then secured by tightening down bolts 76 of the clamping bar 74. Thereafter, positioning plate 80 may be returned to its lower position, as shown in FIG. 6, out of the path of travel of the sharpening file 56.

Figure 7:
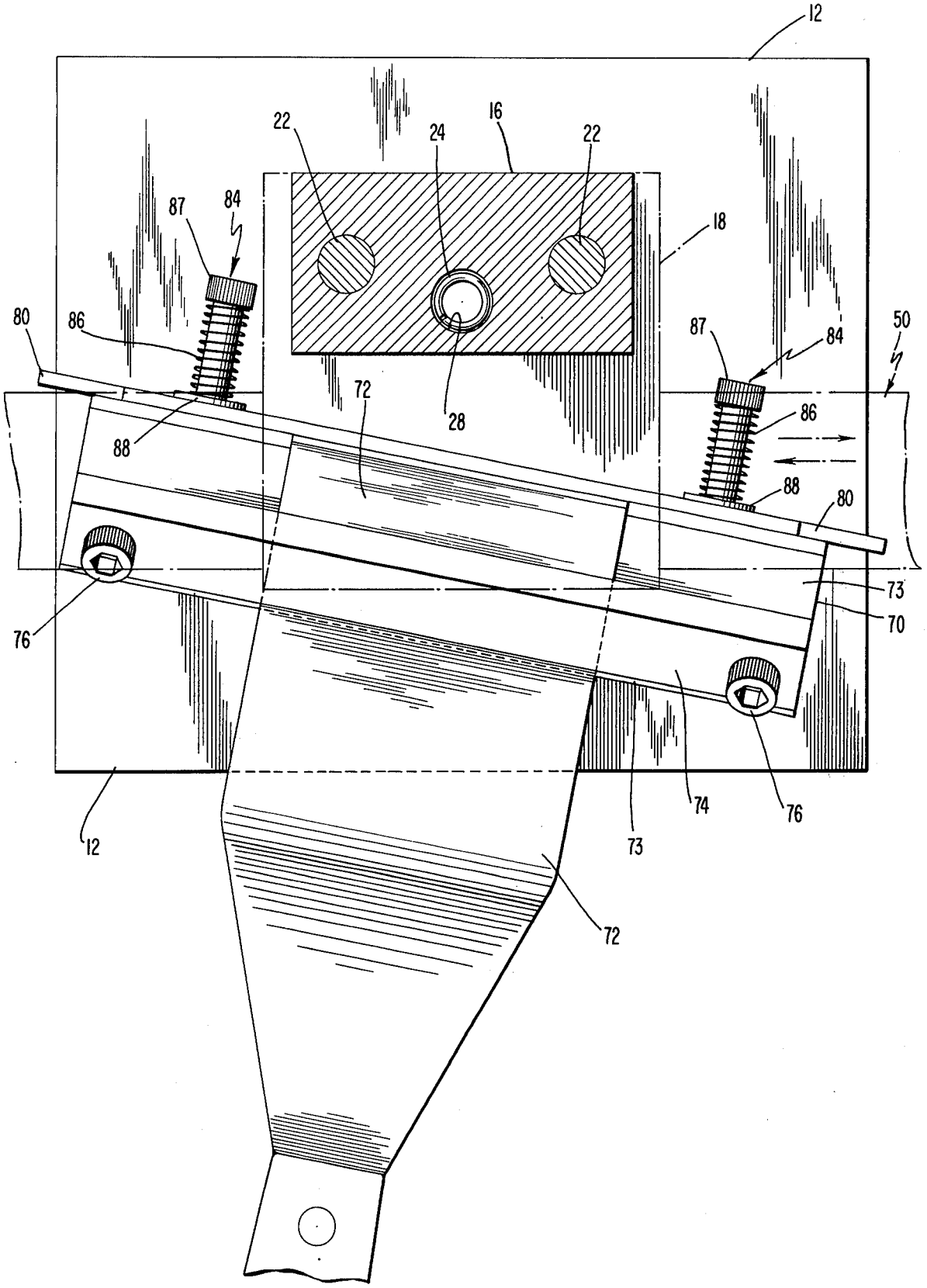
FIG. 7 is a sectional view taken along line 7—7 of FIG. 5.

As best illustrated in FIG. 7, support member 70 is positioned at a slight angle with respect to the path of travel of the file 56. The angle is designed to be sufficient for the working edge of the spatula to contact the face of the file across at least a substantial portion of its width, preferrably its entire width to prevent selective loading of metal in the file, to thereby improve the life thereof, and to minimize the force necessary to effect sharpening of the spatula.

In operation, the floating head 18 will normally be biased away from support member 16 to the extent permitted by the adjustment of bolt 30. This adjustment is normally made so that the face of file 52 is somewhat above the upper end of positioning plate 80, when raised, as shown in FIG. 5. A spatula is inserted beneath plate 74 and rests on the inclined face 73 of support member 70. The position of the spatula is accurately determined by raising positioning plate 80, as shown in FIG. 5, and abutting the end of spatula 72 thereagainst. Bolts 76 are then tightened and positioning plate 80 returned to its normal position, as shown in FIG. 6.

The path which the sharpening element 50 may traverse is confined to two independent, substantially perpendicular directions dictated by the movement of head 18 on guide pins 22 and the movement of guide shaft 64 within ball bushings 40 as limited by the rollers 66. Because of the design of the guide pins, and further because of the presence of rollers 66, no other motion is permitted. Thus, at the beginning of the sharpening stroke, the apparatus generally will be in the configuration illustrated in FIG. 5. As the user applies force to handle member 54 of the file, floating head 18 will move downwardly against the biasing force provided by spring 24 to the position illustrated in FIG. 6 so that the abrasive surface 56 of the file contacts the working edge of spatula 72. Continued movement on the forward stoke causes the file face to rub across the spatula edge as guide shaft 64 moves through the bushings 40 in the floating head. At the end of travel, as the user withdraws the file on the return stroke for the next sweep, release of downward force applied during sharpening allows bias spring 24 to return floating head 18 to the retracted position of FIG. 5.

In the above manner, there is accomplished the sharpening of the spatula only on forward movement of the file. On the reverse sweep, the file is in an "up" position which produces a superior, straight working edge on the spatula, lengthens the life of the file, and minimizes the loading thereof thus reducing the need for frequent cleaning of the file grooves. Because of the angular relationship between the end of spatula 72 and the file face, the operation is smooth and "jerk free" and proceeds in a simple yet highly efficient manner requiring the exertion of little physical force. Thus, the apparatus is capable of use by inexperienced individuals who may quickly, efficiently, and accurately sharpen the ends of spatulas as the need arises.

Inasmuch as the present invention is subject to many variations, modifications and changes in detail, it is intended that all matter contained in the foregoing description or shown in the accompanying drawings shall be interpreted as illustrative and not in a limiting sense.

What is claimed is:

1. Tool sharpening apparatus, comprising:

a base member;

support means on said base member for securely holding a tool having an edge to be sharpened;

a head member reciprocably carried on said base member for movement toward and away from the edge of a tool held by said support means;

a sharpening element slightly mounted on said head member for reciprocable motion in constant planes relative to and generally longitudinally along the tool edge; and means biasing said head member away from the tool edge, whereby said head member is movable downwardly for engagement of the sharpening element with the tool edge on a forward stroke thereof and is urged upwardly to separate the sharpening element from the tool edge on a return stroke.

2. The apparatus as recited in claim 1, further including adjustable stop means operatively engaged between said base member and said head member for limiting the extent of reciprocable motion of said head member.

3. The apparatus as recited in claim 2, wherein said stop means comprises at least one threaded member threadedly carried on said base member and cooperatively engaged with said head member.

4. The apparatus as recited in claim 1, wherein said biasing means comprises compression spring means disposed between said base member and said head member.

5. The apparatus as recited in claim 1, wherein said sharpening element comprises a guide rail, an abrasive sharpening tool attached to said guide rail, and a guide shaft on said rail disposed for reciprocable movement within bearing means in a bore in said head member.

6. The apparatus as recited in claim 5, wherein said abrasive sharpening tool is a file.

7. The apparatus as recited in claim 5, further including roller means attached to said head member and rotatably engaging said rail member for precluding rocking and lateral displacement of said abrasive tool.

8. The apparatus as recited in claim 1, further including positioning means slidably attached to said support means and having a lower retracted position and an upper stop position at which said positioning means forms an abutment against which the working edge of a tool to be sharpened may be placed for accurate alignment thereof.

9. The apparatus as recited in claim 1, wherein said support means is attached to said base member at an angle with respect to the path of movement of said sharpening element whereby the edge of the tool to be sharpened may be engaged by said sharpening element across at least a major portion of the width thereof.

10. The apparatus as recited in claim 1, further comprising guide means including a plurality of guide pins attached to said base member, and a plurality of cooperating bearing means in said head member, whereby said head member is freely reciprocable on said base.

* * * * *